US006092270A

United States Patent [19]

Sawdon

[11] Patent Number: 6,092,270

[45] **Date of Patent: *Jul. 25, 2000**

[54] DIE FOR FORMING A JOINT

[75] Inventor: Edwin G. Sawdon, St. Clair, Mich.

[73] Assignee: BTM Corporation, Marysville, Mich.

[ * ] Notice: This patent is subject to a terminal disclaimer.

[21] Appl. No.: 09/039,947

[22] Filed: Mar. 16, 1998

Related U.S. Application Data

[63] Continuation-in-part of application No. 08/687,352, filed as application No. PCT/US94/08569, Jul. 29, 1994, Pat. No. 5,727,302.

[51] Int. Cl.[7] ..... B23P 11/00

[52] U.S. Cl. ..... 29/243.5; 29/283.5; 72/466.9; 72/482.91

[58] Field of Search ..... 29/21.1, 436, 453, 29/505, 521, 522.1, 243.5, 283.5, 798; 76/4; 72/481, 465, 393, 353.4, 481.1, 465.1, 482.91, 466.9

[56] References Cited

U.S. PATENT DOCUMENTS

| | | |
|---|---|---|
| 1,404,126 | 1/1922 | Krause . |
| 2,670,885 | 3/1954 | Allen . |
| 3,468,527 | 9/1969 | Mather . |
| 3,690,141 | 9/1972 | Brownbill . |
| 4,196,944 | 4/1980 | Simatovich . |
| 4,208,776 | 6/1980 | Schleicher . |
| 4,757,609 | 7/1988 | Sawdon . |
| 4,825,525 | 5/1989 | Obrecht et al. . |
| 4,905,362 | 3/1990 | Obrecht et al. . |
| 4,910,853 | 3/1990 | Sawdon . |
| 4,930,203 | 6/1990 | Obrecht et al. . |
| 4,947,719 | 8/1990 | Whistler . |
| 5,027,503 | 7/1991 | Sawdon . |
| 5,054,347 | 10/1991 | Johnson et al. . |
| 5,087,188 | 2/1992 | Staver . |
| 5,150,513 | 9/1992 | Sawdon . |
| 5,177,861 | 1/1993 | Sawdon . |
| 5,263,238 | 11/1993 | Cooper . |
| 5,438,897 | 8/1995 | Chun . |
| 5,451,288 | 9/1995 | Smith et al. . |
| 5,479,687 | 1/1996 | Sawdon . |
| 5,727,302 | 3/1998 | Sawdon ..... 29/436 |

FOREIGN PATENT DOCUMENTS

| | | |
|---|---|---|
| 1 452 782 | 3/1965 | Germany . |
| 37 26 392 A1 | 2/1989 | Germany . |
| 62-148035-A1 | 7/1987 | Japan . |
| 62-148036-A1 | 7/1987 | Japan . |
| 62-148040-A1 | 7/1987 | Japan . |
| 1299669 A1 | 3/1997 | U.S.S.R. . |

OTHER PUBLICATIONS

International Search Report of PCT/US94/08569 dated Nov. 28, 1994.

*Primary Examiner*—David P. Bryant
*Attorney, Agent, or Firm*—Harness, Dickey & Pierce, P.L.C.

[57] ABSTRACT

A die (24) and punch (32) is employed to form a joint (74) between at least two sheets of material (70 and 72). The preferred embodiment die (24) has a shield (54) surrounding an anvil (52). This shield (54) has at least one aperture (120) extending therethrough.

20 Claims, 6 Drawing Sheets

DIE FOR FORMING A JOINT

CROSS REFERENCE TO RELATED APPLICATION

This application is a continuation-in-part of a U.S. patent application Ser. No. 08/687,352 filed Jul. 25, 1996, now U.S. Pat. No. 5,727,302, which was a National Phase entry under 35 U.S.C. §371 of PCT/US94/08569, which was filed on Jul. 29, 1994.

BACKGROUND AND SUMMARY OF THE INVENTION

This invention relates generally to a joint forming apparatus and specifically to a die and punch for forming a joint between sheets of material.

It is old in the art to join multiple pieces of sheet metal by punching or otherwise manipulating them to cause these sheets to be deformed into an interlocking relationship in a localized area. However, such joints have traditionally required the shearing of the sheet material and hence are not suitable for leakproof applications unless a sealant is applied. The formation of such joints is also frequently destructive of the corrosion resistance of coated materials. In addition, the known apparatuses for forming the joints are frequently complex in design. This complexity increases the cost of the equipment, as well as the energy required for operation.

More recently, the inventor of the present invention has developed an apparatus for producing more cost effective and aesthetically pleasing leakproof and lanced joints. These are known within the industry as TOG-L-LOC® and LANCE-N-LOC® joints which can be obtained from the assignee of the present invention. These improved joints are disclosed within U.S. Pat. No. 5,150,513 which issued on Sep. 29, 1992 and U.S. Pat. No. 5,177,861 which issued on Jan. 12, 1993, both of which are incorporated by reference herewithin.

Moreover, the use of coiled springs to inwardly retain a plurality of movable die pieces against an anvil for joining sheets of material is shown in Japanese Patents 148036 entitled "Joining Device for Thin Metallic Plate" and 148039 entitled "Joining Device for Metallic Sheet." However, in both of these devices, the coiled spring is not canted. Furthermore, an outer sleeve is not shown surrounding the spring and movable die pieces. These references also do not appear to disclose a stripper for use in combination with the punch.

The TOG-L-LOC® and LANCE-N-LOC® joints are commonly formed within a C-shaped toggle press. Such a toggle press is disclosed in U.S. Pat. No. 3,730,044 entitled "Fluid Operated Apparatus" which issued to the inventor of the present invention on May 1, 1973, and is incorporated by reference herewithin. Although such a conventional toggle press is cost effective and reliable, the punch and die tends to bow outward from their desired longitudinal axis during formation of a joint therebetween. Therefore, the edges of the punch and die anvil are highly stressed and may be prematurely worn or fracture.

In accordance with the present invention, the preferred embodiment of a die and punch assembly is employed to form a joint between at least two sheets of material. The preferred embodiment die has a shield surrounding an anvil. This shield has at least one aperture extending therethrough. In another aspect of the present invention a canted coil spring expandably retains at least three die blades between the shield and the anvil. In a further aspect of the present invention, the shield is snappably engagable with a die body. In yet another aspect of the present invention, an upper edge of at least one die blade is substantially coplanar with an upper edge of the shield prior to a joint being formed thereagainst. In still another aspect of the present invention, either the anvil, punch, or both has a frusto conical taper disposed along a peripheral edge thereof. In another aspect of the present invention, an external surface of a stripper has substantially the same diameter as does an outside surface of the shield.

The die and punch assembly of the present invention are advantageous over conventional devices in that an aperture in the present invention die shield allows for self-cleaning during operation. The present invention die shield and blades are also advantageous by having substantially coplanar upper edges so as to provide additional sheet material support during joint formation. Another advantage of the present invention is that the frusto conical taper on the punch, anvil, or both peripheral edge prevents high stress concentrations and improves the tool life. The snap together construction of the shield and die body allows for easy and low cost assembly and processing while achieving more uniform tolerances during heat treating. Additional advantage and features of the present invention will become apparent from the following description and appended claims, taken in conjunction with the accompanying drawings.

BRIEF DESCRIPTION OF THE DRAWINGS

FIG. 6 is a side elevational view showing an alternate embodiment shield used in the die of the present invention of FIG. 1;

DETAILED DESCRIPTION OF THE PREFERRED EMBODIMENT

Figure 1:
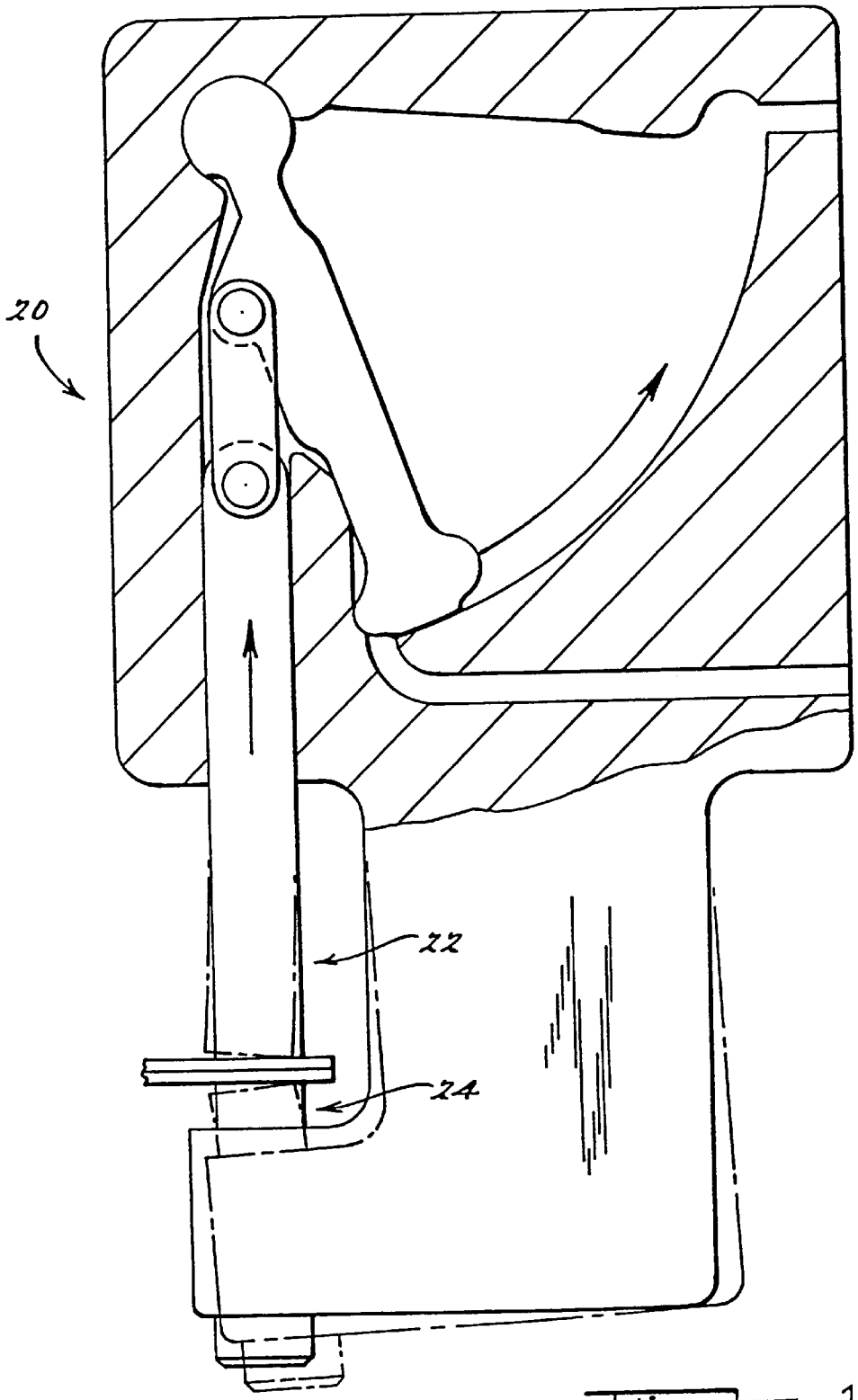
FIG. 1 is a diagrammatic side elevational view, partially in section, showing a toggle press employing a preferred embodiment of a punch assembly and a die of the present invention.

Referring to FIG. 1, a toggle press 20 is diagrammatically shown employing the preferred embodiment of a punch assembly 22 and a die 24 of the present invention. Such C-shaped toggle presses are well known within the art. When punch assembly 22 compressibly deforms a joint against die 24, punch assembly 22 and die 24 tend to bow outwardly with the press frame. Such an outward bow is shown in an exaggerated form by the phantom lines. However, this undesired bowing creates high stress loading on the peripheral contact edges of a die anvil and a punch. Of course, one skilled in the art would know that other traditional presses, such as hydraulic in-line presses or an accordion-type toggle press, could be employed with the punch assembly and die of the present invention.

Figure 2:
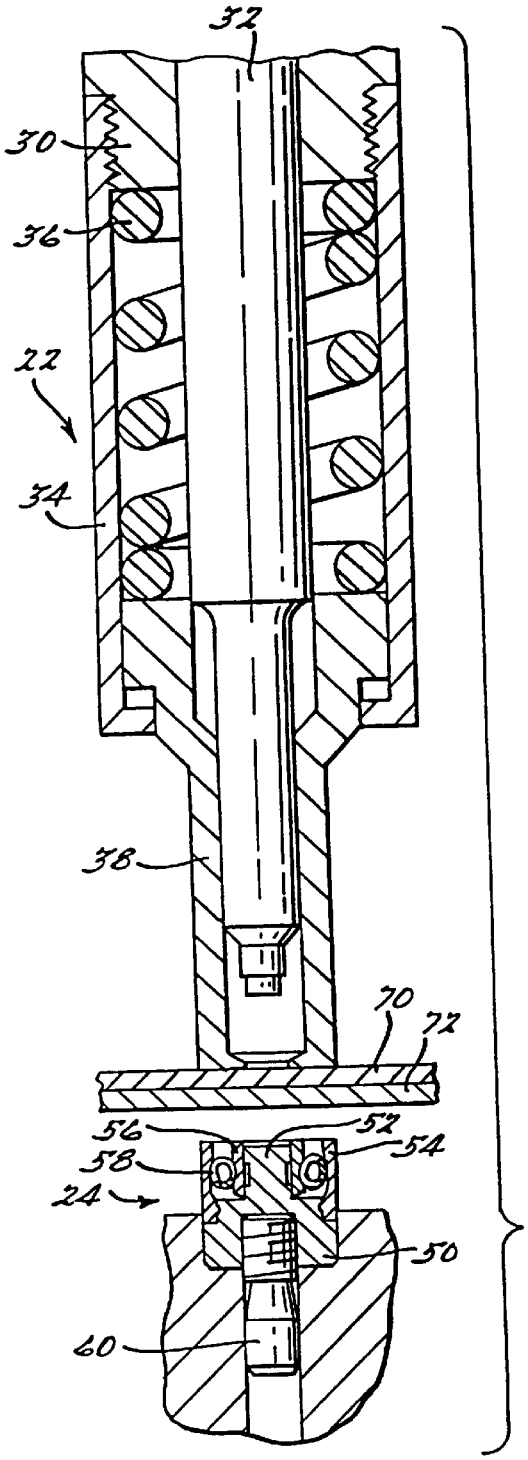
FIG. 2 is a front elevational view, partially in section, showing the preferred embodiment punch assembly of the present invention in its retracted position relative to the preferred embodiment die of the present invention of FIG. 1.
Figure 3:
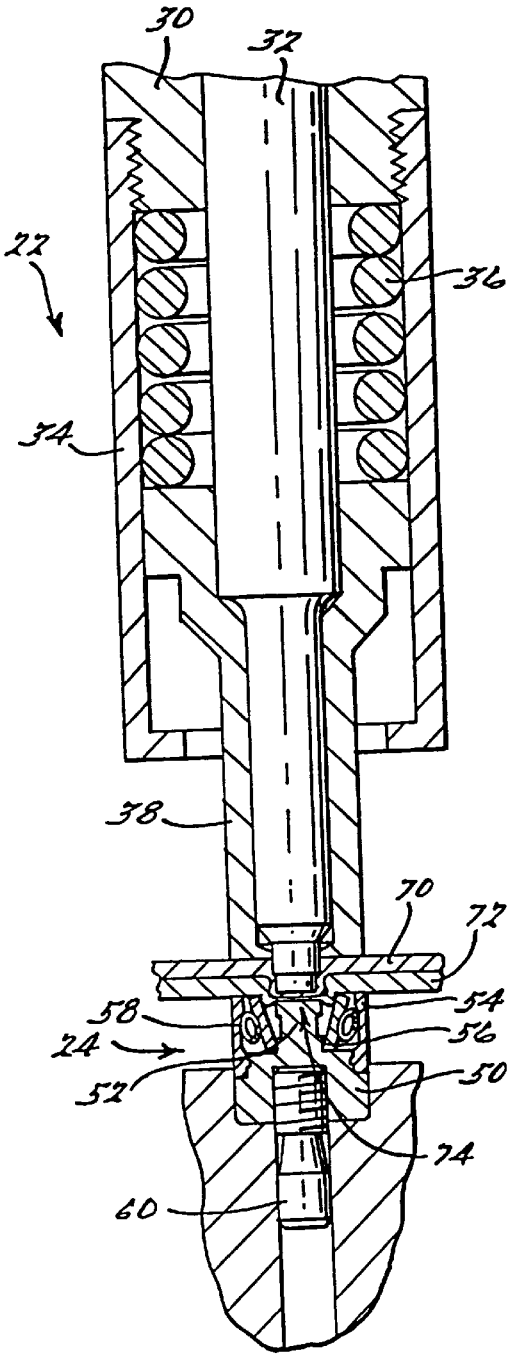
FIG. 3 is a front elevational view, partially in section, showing the preferred embodiment punch assembly of the present invention in its advanced position relative to the preferred embodiment die of the present invention of FIG. 1.
Figure 4:
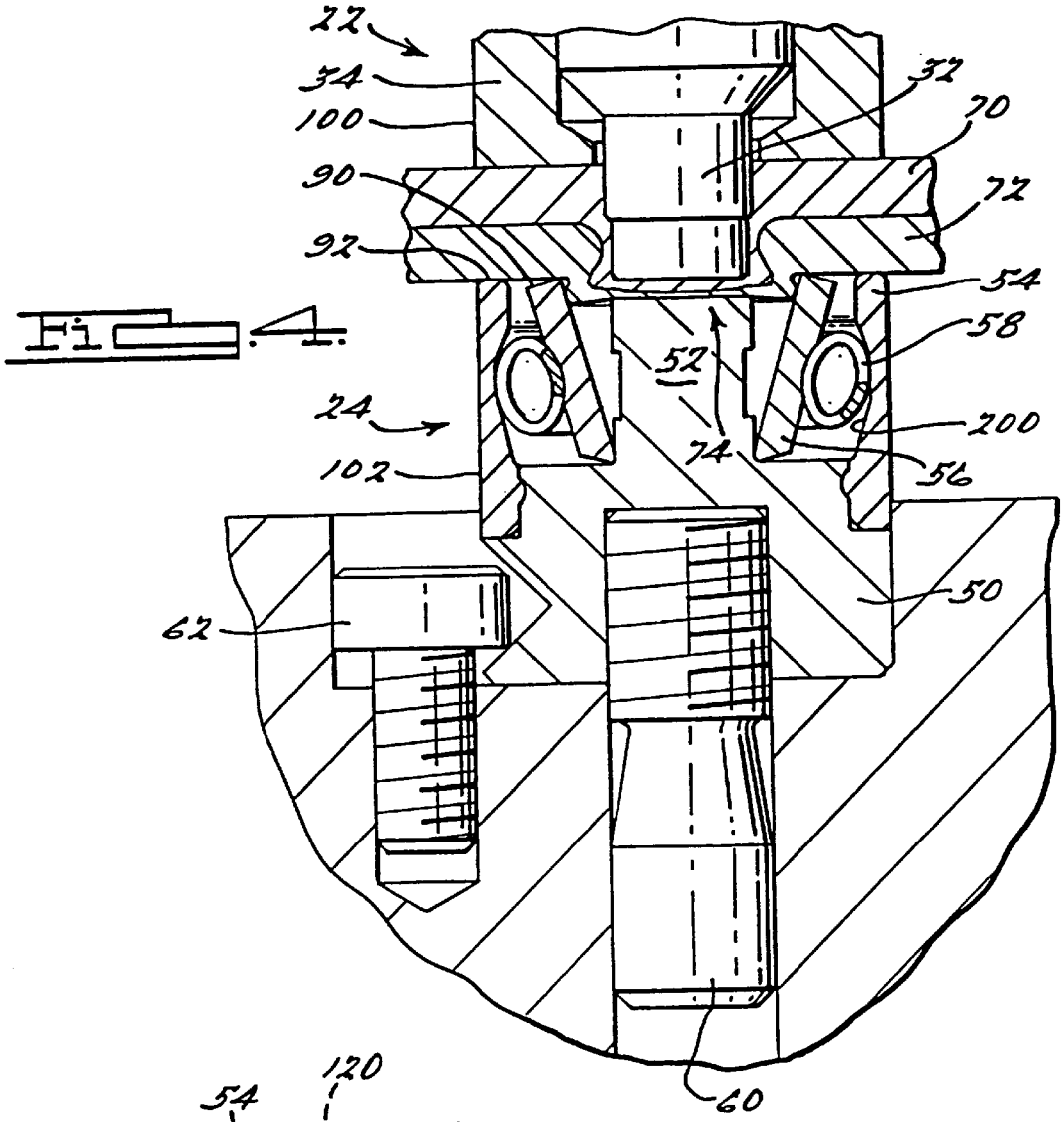
FIG. 4 is an enlarged front elevational view, partially in section, showing a joint created by the preferred embodiment punch assembly and die of the present invention of FIG. 1.

As can best be observed in FIGS. 2–4, punch assembly 22 includes a punch holder 30, a punch 32, a housing 34, a compression spring 36 and a stripper 38. Aligned therewith, die assembly 24 includes a die body 50 having an anvil 52 integral therewith, a shield or guard 54, three movable die blades 56, a canted coil spring 58, a dowl 60 and a bolt 62. At least two sheets of deformable material 70 and 72 are formed between punch assembly 22 and die 24 so as to create a leakproof interlocking joint 74. While three expandably movable die blades 56 are preferably disclosed herein, it should also be appreciated that a single stationary die blade may be disposed around anvil 52 with a trough therebetween. An elastomeric band, compression spring or leaf spring may alternately be employed to retain movable die blades 56 within die 24. Moreover, a LANCE-N-LOC® joint, an embossment, a bending operation or other such action may also be performed within the punch assembly and die of the present invention.

Figure 5:
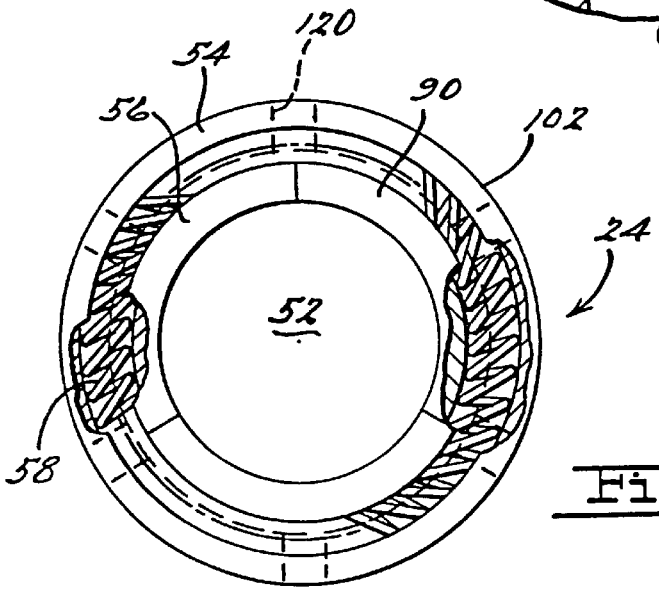
FIG. 5 is an enlarged top elevational view, with portions broken away therefrom, showing the preferred embodiment die of the present invention of FIG. 1.
Figure 7:
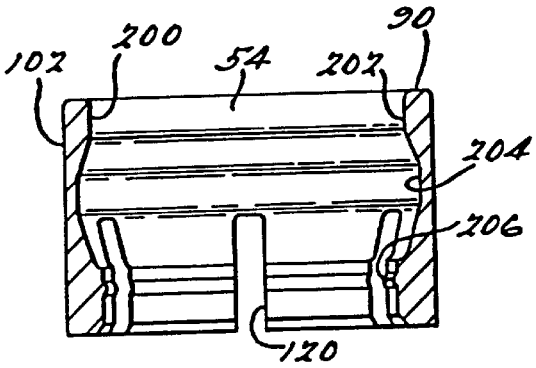
FIG. 7 is a fragmentary side elevational view showing the alternate embodiment shield used in the die of the present invention of FIG. 6.

Referring to FIGS. 4 and 5, each die blade 56 has an upper edge 90 which is substantially coplanar with an upper edge 92 of shield 54 prior to joint 74 being formed within die 24. This coplanar nature of the upper edges of die blades 56 (when in their nominal positions) and shield 54 provides for improved support of material sheets 70 and 72 during joint formation and removal from die 24. Materials sheets 70 and 72 are preferably steel or aluminum but may also be any other deformable material and may further be of varying thicknesses.

Stripper 34 is defined by an external surface 100 which has substantially the same diameter as does an outside cylindrical surface 102 of shield 54. This substantially identical diameter of stripper 34 and shield 54 provides for improved stripping action efficiency and uniform stripping action therebetween.

Referring now to FIGS. 5 and 6, an alternate embodiment of shield 54 includes six slot shaped apertures 120 which are open toward a bottom edge 122 and a continuously annular, protruding ridged snap fit segment 206. These slotted apertures 120 allow for self cleaning of die 24. Such self cleaning is achieved during normal movement of die blades 56 and canted spring 58. Accordingly, any lubricating or cooling fluid as well as dirt, sheet material oil and other debris may be expelled through slotted apertures 120.

Figure 8:
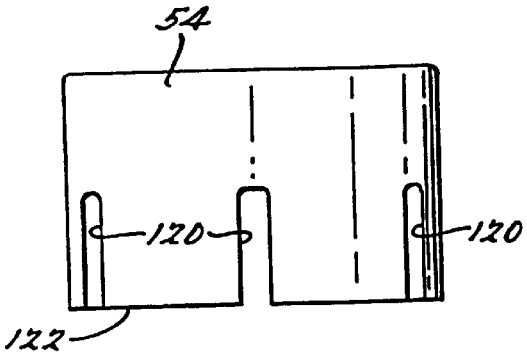
FIG. 8 is a side elevational view showing the preferred embodiment shield used in the present invention die of FIG. 1.
Figure 8:
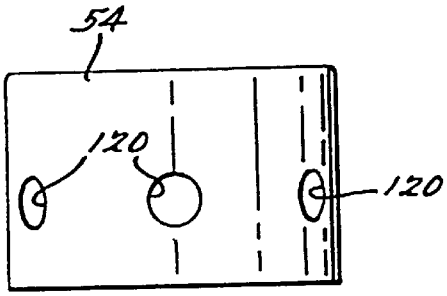
Figure 9:
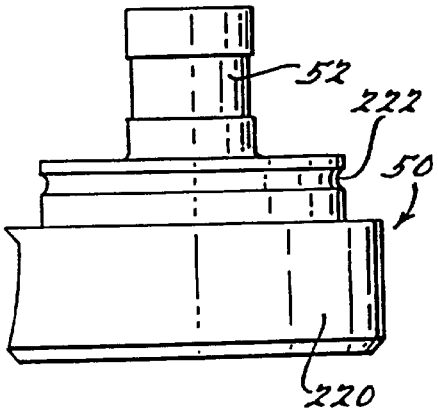
FIG. 9 is a side elevational view showing a preferred embodiment die body used in the present invention die of FIG. 1.
Figure 10:
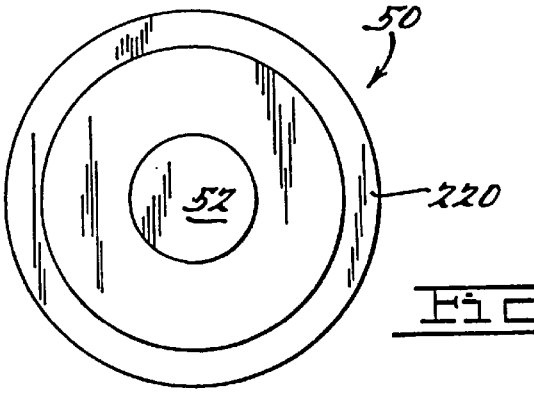
FIG. 10 is a top elevational view of the preferred embodiment body used in the present invention die of FIG. 9.

The preferred embodiment design of shield 54 is shown in FIG. 8. This preferred embodiment includes six evenly spaced apertures 120 each having a circular shape.

FIGS. 4, 9, 10 and 13–15 show shield 54 further having an inside surface 200 defined by a nominal segment 202, a spring retaining depressed segment 204 and inwardly protruding ridged snap fit segments or tabs 206'.

There are preferably three distinct segments 206' which are spaced apart from each other by angles $\alpha$ of 120°. This separation allows the nominal wall thickness between segments 206' to flex and deflect thereby significantly easing assembly and disassembly of the shield to the die body. Each segment 206' has a die body engaging surface 452, of about 0.10 inch, which is curved substantially parallel to nominal surface 202. A 0.156 inch radius 454 joins each segment 206' to nominal surface 202.

Die body 50 includes a substantially cylindrical die foot 220 and anvil 52. A circumferential snap fit groove 222 is also disposed around a peripheral portion of die body 50. Groove 222 of die body 50 is designed to snappably receive protruding segments 206' of shield 54. Thus, shield 54 can be snap fittably attached to die body 50 by use of an arbor press. Alternately, more than three separated segments may be employed having different sizes, the groove and protruding snap fit means may be reversed, or they may take on flexible beam and barb configurations. Both shield 54 and die body 50 are made from M2 steel which are hardened and ground to Rc 57–61.

The snap fit attachment between shield 54 and die body 50 provides for processing efficiencies and improved tolerances between parts. Shield 54 and die body 50 are first individually machined to their desired shapes. Second, shield 54 is snapped onto die body 50. Third, the combined parts are heat treated and then burnished in a slurry of granite and water to remove burrs. A titanium nitride coating is then applied to the combined parts. Thereafter, canted coil spring 58 is inserted around die blades 56 and then the die blade and spring combination are installed within shield 54.

Figure 11:
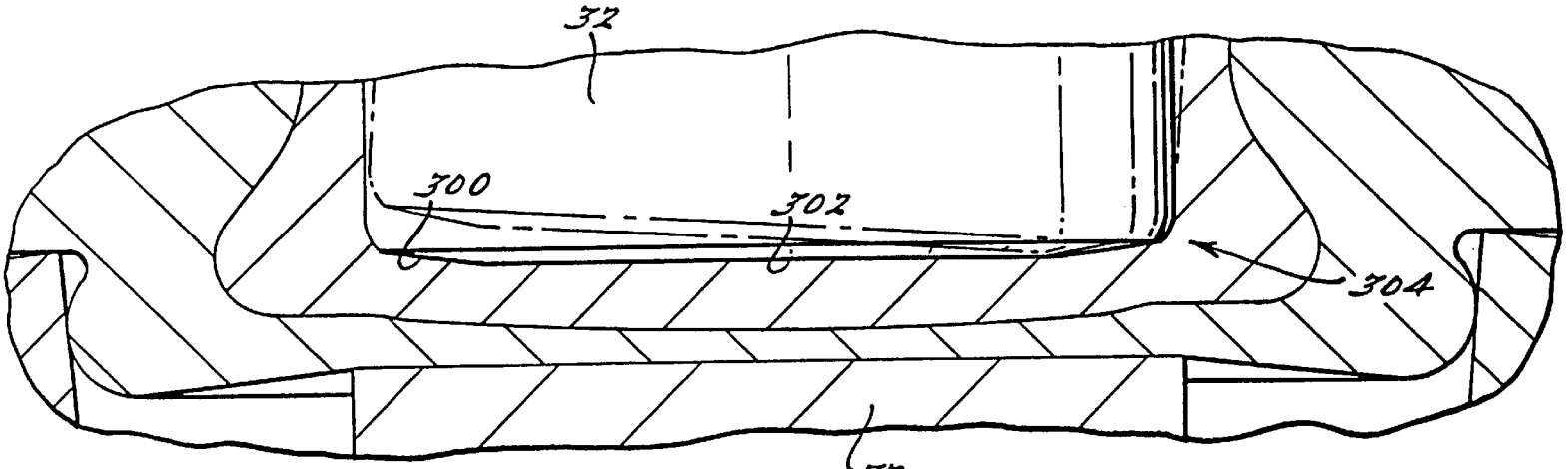
FIG. 11 is an enlarged cross sectional view showing a frusto conical taper disposed on a punch of the present invention of FIG. 4.
Figure 12:
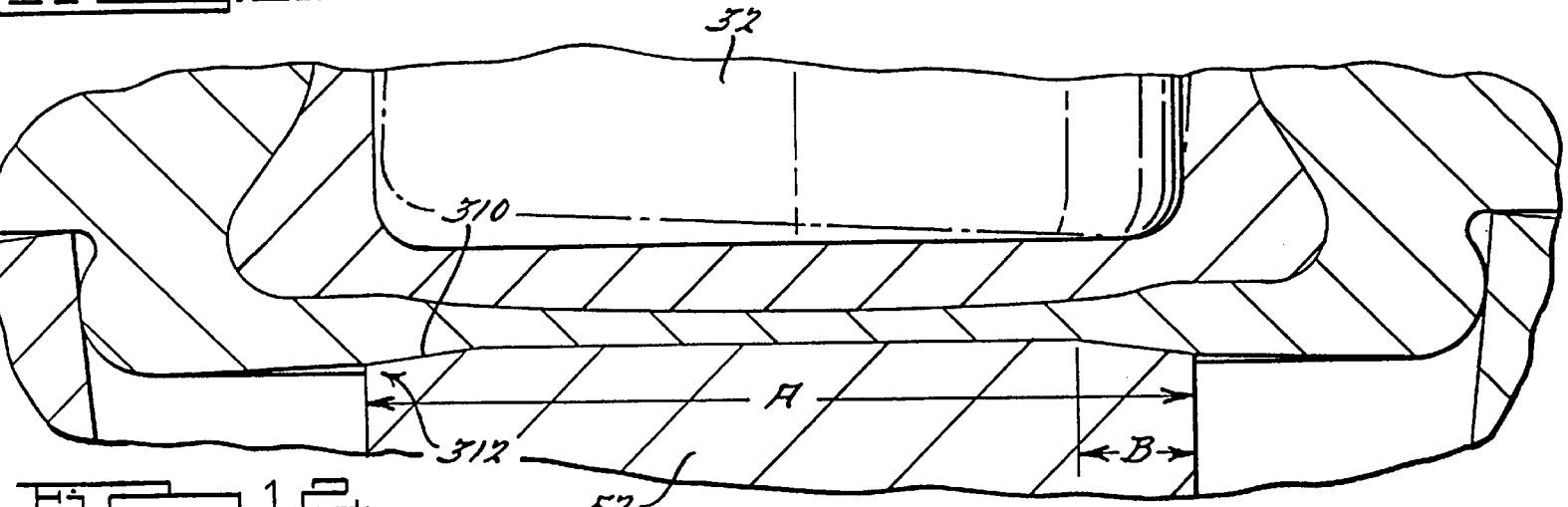
FIG. 12 is an enlarged cross sectional view showing a frusto conical taper disposed on an anvil of the present invention of FIG. 4.
Figure 13:
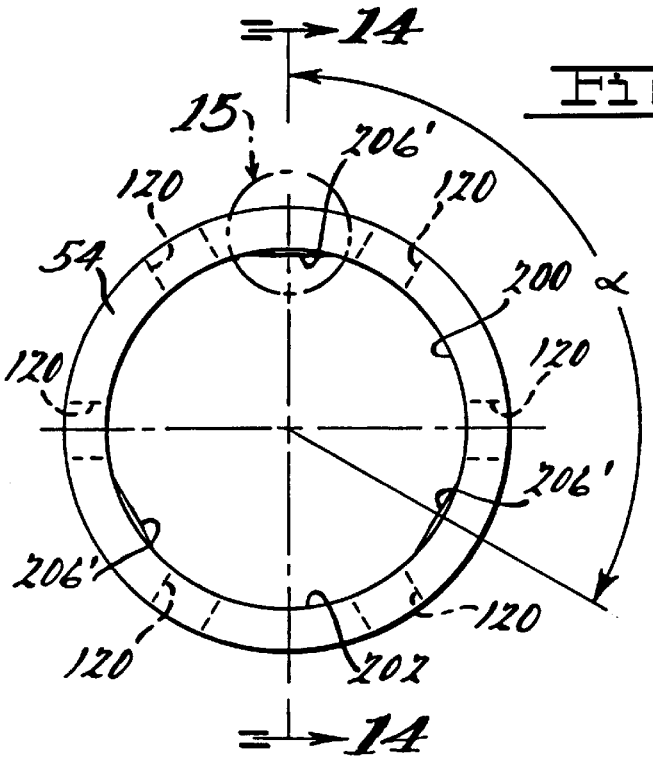
FIG. 13 is a top elevational view showing the preferred embodiment shield used in the present invention die of FIG. 1.
Figure 14:
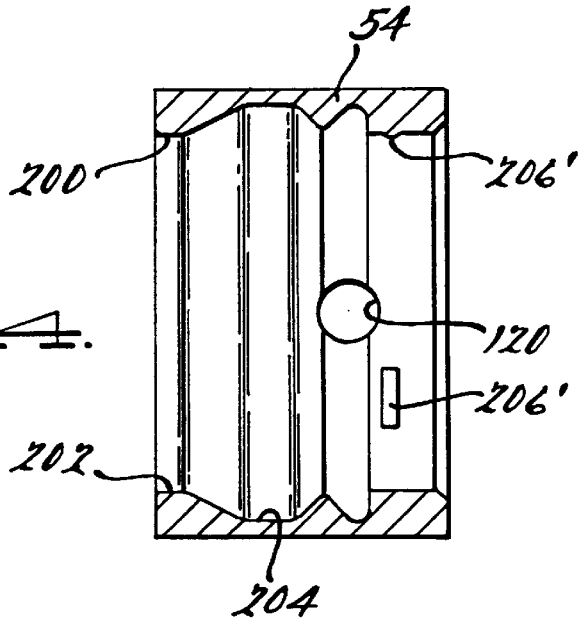
FIG. 14 is a cross section view, taken along line 14—14 of FIG. 13, showing the preferred embodiment shield use in the present invention die of FIG. 13.
Figure 15:
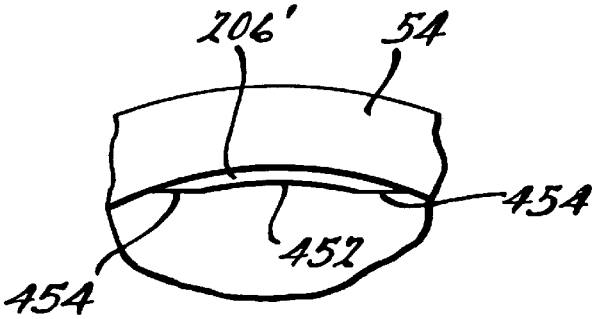
FIG. 15 is an enlarged fragmentary top elevational view, taken in circle 15 of FIG. 13, showing the preferred embodiment shield used in the present invention die of FIG. 13.

Referring to FIG. 11, the present invention provides for a frusto conical taper 300 of 5° as measured from a plane defined by a contact surface 302 of punch 32. This taper 300 intersects with a radius of 0.010 inches disposed along a peripheral contact edge 304 of punch 32. Alternately, FIG. 12 shows a 5° frusto conical taper 310 disposed along a peripheral contact edge 312 around anvil 52 adjacent to a contact surface. A radius may also be disposed partially at the corner thereof. These frusto conical tapers can be calculated as follows:

$$B = \frac{(A \times 80\%) - A}{2}$$

where A is defined as the anvil diameter; and

B is the lateral dimension of the taper. The tapers of FIGS. 11 and 12 serve to reduce stress concentrations along the corners of the anvil and punch during any misalignment and bowing that occurs during joint formation (as is shown in phantom). Of course, other angles may be employed for the tapers depending on the specific application.

While the preferred embodiment of this die and punch assembly have been disclosed, it will be appreciated that various modifications may be made without departing from the present invention. For example, an anvil may be separately retained to a die body. Furthermore, a shield may be attached to a die body by set screws, welding or other such attachment means. A number of other polygonal or curved shapes may be used for the disclosed cleaning apertures within the shield. Moreover, many other punch and stripper configurations may be employed in combination with the die of the present invention. Various materials and dimensions have been disclosed in an exemplary fashion, however, a variety of other materials and dimensions may of course be employed. It is intended by the following claims to cover these and any other departures from the disclosed embodiments which fall within the true spirit of this invention.

The invention claimed is:

1. A die for forming a joint in sheets of material, said die comprising:

a die shield having a groove disposed in a surface; and a die body having a surface with a protruding segment, said protruding segment of said die body being snappably engagable with said groove of said die shield.

2. The die of claim 1 further comprising an anvil coaxially disposed in said shield and attached to said die body.

3. The die of claim 2 further comprising at least three of die blades laterally surrounding said anvil and having portions which longitudinally project beyond said anvil, said at least three die blades being laterally movable away from said anvil during formation of said joint.

4. A die for forming a joint in sheets of material, said die comprising:

at least one groove located on a first member; and a set of protruding segments spaced from each other and located on a surface of a second member, said set of protruding segments being snappably engagable with said groove of said second member.

5. The die of claim 4 wherein said second member includes an annular die shield.

6. The die of claim 5 further comprising an anvil coaxially disposed in said shield and attached to said first member which is a die body.

7. The die of claim 6 further comprising at least three of die blades laterally surrounding said anvil and having portions which longitudinally project beyond said anvil, said at least three die blades being laterally movable away from said anvil during formation of said joint.

8. A joining system comprising:

a punch;

a die including a die body component and a die shield component, said die components being secured together by at least one protruding segment interfacing with at least one groove; and workpieces operably joined together by said punch acting against said die.

9. The joining system of claim 8 wherein said punch operably advances toward said die and said die body is stationary.

10. The joining system of claim 9 wherein said die further includes an anvil projecting from said die body and a set of die blades movable relative to said anvil.

11. The joining system of claim 10 wherein said anvil is stationary during movement of said punch, and said anvil is machined as part of said die body.

12. The joining system of claim 8 wherein said die shield further includes a nominal inside surface having a depression.

13. The joining system of claim 12 further comprising a spring located at least partially in said depression.

14. The joining system of claim 13 further comprising die blades inwardly biased away from said die shield by said spring.

15. The joining system of claim 8 further comprising a leakproof interlocking joint is formed between said workpieces by said punch and said die.

16. The joining system of claim 8 wherein said die shield has an external surface with multiple apertures.

17. The joining system of claim 8 further comprising an anvil projecting from said die body, said anvil and said die shield having substantially circular and concentric, external peripheral shapes.

18. The joining system of claim 8 further comprising:

a stripper at least partially surrounding said punch; and a spring biasing said stripper relative to said punch.

19. The joining system of claim 8 wherein said protruding segment engages said groove in a snap-fit manner.

20. The joining system of claim 8 wherein said at least one protruding segment includes at least two radially spaced apart and substantially co-planar protruding formations.

* * * * *

UNITED STATES PATENT AND TRADEMARK OFFICE

CERTIFICATE OF CORRECTION

PATENT NO. : 6,092,270
DATED : July 25, 2000
INVENTOR(S) : Edwin G. Sawdon

It is certified that error appears in the above-identified patent and that said Letters Patent is hereby corrected as shown below:

Column 1, line 6, after "a" (second occurrence) insert -- copending --.

Column 1, line 60, "fracture" should be -- fractured --.

Column 3, line 8, "use" should be -- used --.

Column 6, line 29, delete "is".

Signed and Sealed this

Fifteenth Day of May, 2001

*Attest:*

Nicholas P. Godici

NICHOLAS P. GODICI

*Attesting Officer*

*Acting Director of the United States Patent and Trademark Office*